United States Patent [19]

Beaudry

[11] 4,355,650

[45] Oct. 26, 1982

[54] PORTABLE SHELTER

[76] Inventor: Jean Beaudry, Apt. 411, 565 St. Charles West, Longueuil, Quebec, Canada, J4H3X8

[21] Appl. No.: 155,841

[22] Filed: Jun. 2, 1980

[51] Int. Cl.[3] ..... A45F 1/14

[52] U.S. Cl. ..... 135/7.1 R; 135/4 R; 135/15 CF; 135/15 PE

[58] Field of Search ..... 135/4 R, 5 R, 15 PE, 135/7.1 R, 15 CF

[56] References Cited

U.S. PATENT DOCUMENTS

| | | | |
|---|---|---|---|
| 1,105,884 | 8/1914 | Crites | 135/15 PE |
| 2,811,977 | 11/1957 | McClish | 135/5 |
| 2,829,659 | 4/1958 | Megenity | 135/5 |
| 2,969,075 | 1/1961 | Girten | 135/5 |
| 3,155,427 | 11/1964 | Necessar | 297/184 |
| 3,190,300 | 6/1965 | Wear'n | 135/5 R |
| 3,242,935 | 4/1966 | Williams | 135/4 R |
| 3,581,751 | 6/1971 | Evans | 135/5 |
| 3,995,649 | 12/1976 | Robichaud | 135/4 R |
| 4,098,281 | 7/1978 | Bonfilio | 135/5 R |
| 4,285,355 | 8/1981 | Lundblade | 135/4 R |

*Primary Examiner*—Reinaldo P. Machado
*Attorney, Agent, or Firm*—Richard M. Saccocio

[57] ABSTRACT

A portable and collapsible shelter is provided which includes a plurality of bows attached to a pair of spaced hubs. The bows are made up of three interlocking pieces which are held together by the tautness of the covering of the shelter. The shelter is prevented from collapsing by the inherent collapsing forces of the shelter in conjunction with side braces pinned together and locked, by the collapsing forces, within a keyhole slot formed in the center bow. A unique anchoring system comprising an anchor, which also serves as a digging tool and a tie rod, is used to anchor the shelter.

12 Claims, 7 Drawing Figures

PORTABLE SHELTER

BACKGROUND OF THE INVENTION

1. Field of the Invention

This invention relates, in general, to the field of personnel shelters and, more particularly, to shelters providing people with protection against the natural elements, which shelters are portable and easily erected on site.

2. Description of the Prior Art

There are many instances where people desire to shelter themselves against the natural elements with the use of devices which are something more than a shade umbrella but less than a tent. In these instances, the shelter is usually used by two people, although the end use need not be so restricted. Then too, such shelters are usually used for relatively short periods of time which might be measured in hours rather than days. Such applications include protection from the sun and wind at a seashore, lake site, riverside, or even at home in a backyard or on a sundeck. Another application would include protection from the cold, wind, snow, sleet, etc., while ice fishing. There are, or course, still further applications not mentioned herein where such a shelter might be used.

With these applications or end use in mind, there are certain characteristics of a shelter which are considered highly desirable. For example, it is highly desirable that the shelter be easily transported by one person. Thus, it should be lightweight and be of a shape (when collapsed) which is not cumbersome and promotes easy handling and carrying. It should be compact, for convenience of storage and for convenience of transporting within the confines of a trunk or the interior of an automobile. The shelter must necessarily be collapsible and should be easily erected by one person under varying weather conditions. Of course, the material from which the shelter is made must provide the requisite protection against the weather to the persons using the shelter. Thus, it should be waterproof and windproof. The shelter itself must not or should not be adversely affected as a result of being exposed to the weather. In summary, a shelter of the type considered herein should perform its function while providing a high degree of convenience during transporting, erecting, collapsing, and storage.

That there is a need for the improved shelter described hereinafter is attested to by the fact that in practice, one rarely encounters portable personnel shelters but there is described in the literature a relatively large number of such shelters.

For example, in U.S. Pat. No. 4,098,281 (1928), a collapsible shelter is disclosed having a central hub and a plurality of ribs extending radially outward from the hub. The ribs are maintained in an extended position by "X"-shaped links pinned at their center and having oppositely disposed "U"-shaped flanges at their ends. In another embodiment, the ribs are extended by concavely-shaped bars pinned at their inner ends which when forced beyond a horizontal position, lock into position. The outer covering of the shelter is stated to be fastened to the ribs in a suitable manner.

In U.S. Pat. No. 3,190,300 (1965), a plurality of "C"-shaped ribs are connected at their ends to a hub. Thus, two hubs are used. The resulting structure defines, in effect, one-quarter of a sphere with the hubs being located at the ends of a diametrical line. The shell or outer fabric is stitched to each of the ribs. The structure is held in an extended or erected position by a flexible, springlike strap which is secured to the middle of the first and last rib members. When the structure is collapsed, the rib members and the outer covering are bent around the hoop-like shape of the strap to facilitate storage and transportation.

Still another type of portable shelter is disclosed in U.S. Pat. No. 2,829,659. In side view, the erected shelter approximates the shape of one-quarter of a circle; in front view, the structure has the "U"-shaped appearance. Two hubs are used in this shelter with "U"-shaped ribs being attached thereto. A pivot joint is provided at the intersection of the straight and the curved portions of the ribs. The pivot joint allows for compactness of the ribs when the shelter is collapsed. When the structure is erected, a sliding sleeve locks the pivot joint to effectuate a rigid rib. As in U.S. Pat. No. 3,190,300, a resilient compression bar located along the middle points of the "U"-shaped ribs is attached to the end ribs to maintain the structure in an erected position. The canvas covering in this teaching is also stitched to each of the supporting ribs.

A foldable shelter is also disclosed in U.S. Pat. No. 3,242,935 (1966). Three one-piece "U"-shaped bows are utilized to support the fabric covering. Two oppositely spaced hubs are again used. The hub design includes a pair of axially aligned slots. One of the slots is elongated; the other is open ended and is formed in the end of the hub. Rivets, permanently attached to the end of a bow extend within the slots. The head of the rivet in the elongated slot permanently attaches the bow to the hub while allowing for relative rotation between the hub and the bow. The tautness of the fabric covering forces the other rivet in the open-ended slot such that in combination the two rivets and the two slots preclude rotation of the bows when the shelter is erected. The collapsed size and shape of the structure in this art is dictated by the size and shape of the single piece support bows or ribs.

In U.S. Pat. No. 2,811,977, "U"-shaped bows are maintained in an open or extended position by toggle links attached to the bows at the vertical sides of the structure. Each side of the structure has a two piece link pinned at its center with one end being attached to the first bow and the other end to the last bow. In erecting the structure, the bows are manually fanned apart and the toggle links are forced past their dead center point. Offset arms at the center of the links cause the links to lock together when forced past dead center.

Additional cabanas, sun shelters, portable shelters, foldable shelters, stadium seats, etc., are disclosed in U.S. Pat. Nos. 3,155,427 (1964), 3,581,751 (1971) 2,969,075 (1961), and 3,848,615 (1974).

All of the above, as previously stated, are intended to provide sheltering from the natural climatic elements by a shelter which is easily stored, transported, erected and collapsed. In the prior art, however, in attempting to achieve these objects, the shelters sacrifice either one or more of the stated objectives in order to achieve the other objectives, or the resulting structure introduces an undesirable high degree of complexity.

Accordingly, the principal object of the present invention is to provide a portable and collapsible shelter which is simple and uncomplicated and yet folds to a small size, is lightweight and easy to carry, is easily erected and collapsed, and is large enough to house or shelter more than one person.

A particular object of the invention then is to provide a portable and collapsible shelter which when erected is sufficiently large to accommodate a number of persons, yet when collapsed, is sufficiently compact permitting ease of transporting within a conventional automobile.

Another particular object of the invention is to provide a portable and collapsible shelter which is simple in design and construction so as to be long lasting and highly reliable.

Another particular object of the present invention is to provide a portable and collapsible shelter which is easily and quickly erected and collapsed by one person.

Still another and further particular object of the present invention is to provide a portable and collapsible shelter which is easily and securely anchorable on a natural surface such as sand or earth.

SUMMARY OF THE INVENTION

In accordance with the above objectives, the present invention overcomes the deficiencies of the prior art by providing a portable and collapsible shelter comprising a plurality of support ribs or bows which are pivotally mounted to a hub at each end thereof. Each rib is made up of at least three completely separable pieces. The fabric covering of the structure provides compressive forces to the bows to maintain the assembled condition of the bows without the need for additional fasteners or locking devices.

The structure, when erected, is maintained in an open position by a unique pair of side braces which are positioned at the vertical sides of the structure. A first side brace is pivotally attached to the rib which rests on the ground; a second brace is pivotally attached to the rib forming the entrance to the structure. The braces are pivotally attached to each other at their other ends by a rivet. A keyhole slot is provided in the center rib for purposes of receiving the head of the rivet attaching the two braces to each other. The large portion of the keyhole slot is positioned closest to the hub while the smaller elongated portion of the slot extends away from the hub. When the ribs or bows are fully fanned out, the head of the aforementioned rivet fits within the elongated portion of the keyhole slot and the braces form an angle with each other with the apex of the angle extending away from the hub.

The outer covering of the shelter is then snap fastened to the first and last bows. The resulting tautness of the outer covering provides a force which tends to cause the bows to collapse. Such force, however, in conjunction with the angle formed by the braces, firmly locks the rivet head within the elongated portion of the keyhole slot and thereby prevents the structure from collapsing.

A combination digging tool and anchor prevents the structure from being moved by the wind when erected. A tie rod is pivotally attached to each hub and extends therefrom into the ground. A small trench is dug into the ground at the location of the hub with the aid of the combination tool. When an appropriate depth is achieved, the tool is engaged with the tie rod, forming an inverted "T" within the trench. The trench is then backfilled with earth or sand which buries the anchor within the covered over trench.

With the forgoing objects and summary in view and such other objects as are or will be apparent to those skilled in the art of this invention, the invention consists essentially in the arrangement and construction of parts as hereinafter more particularly shown and described, reference being had to the accompanying drawings, in which:

DESCRIPTION OF THE PREFERRED EMBODIMENTS

Figure 1:
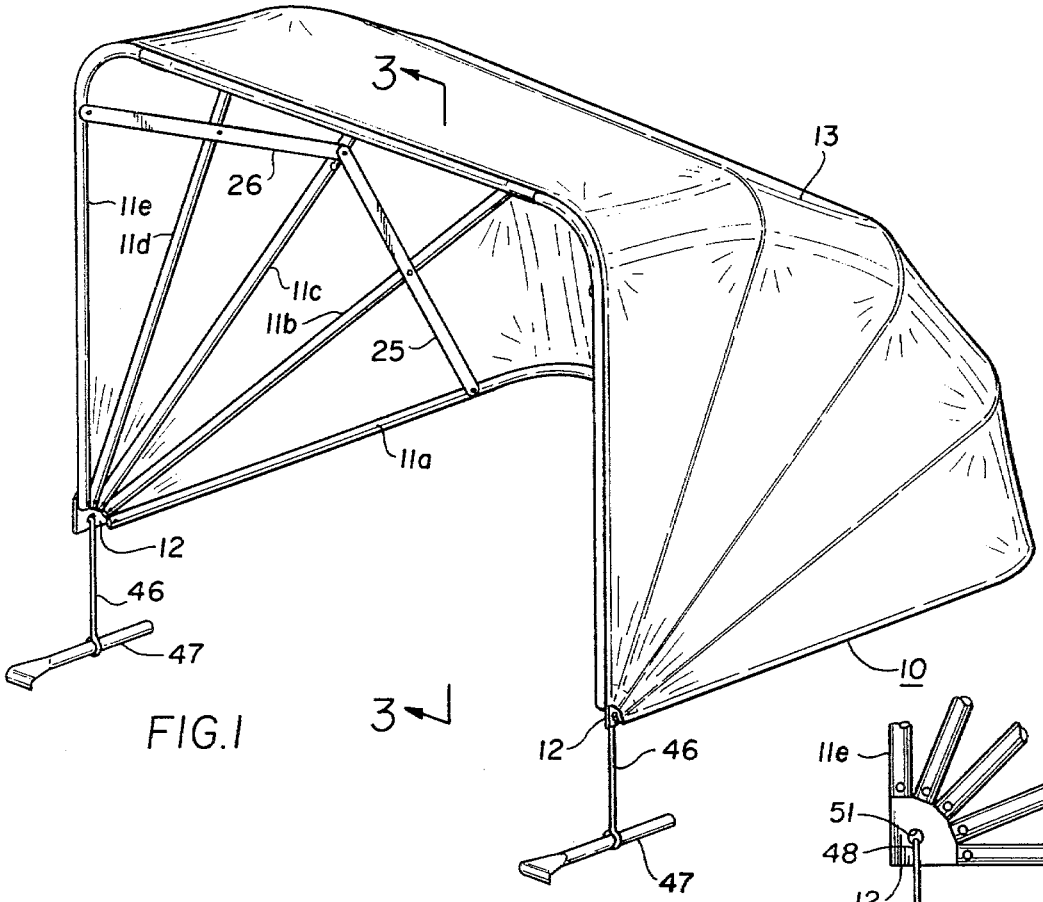
FIG. 1 is a perspective view of the inventive, portable and collapsible shelter showing the same in an erected position.

Referring now to FIG. 1 of the drawings, one embodiment of the improved portable and collapsible shelter is shown therein in an erected position and generally designated by the numeral 10. A plurality of bows 11 extend from a pair of spaced hubs 12. An outer covering or shell 13 extends across the outer surface of bows 11 and bridges the spaces therebetween to form a complete covering of shelter 10. Covering 13 may be made from any appropriate lightweight material such as sailcloth, canvas, nylon, polyethylene, or other plastic, or the like. It is preferable that covering 13 be sufficiently strong to be able to withstand the stresses associated primarily with being stretched over and between bows 11. On the other hand, covering 13 should be sufficiently lightweight and foldable so as to result in a compact package upon structure 10 being collapsed and packaged. In the embodiment illustrated in FIG. 1, a total of five bows, 11*a*, 11*b*, 11*c*, 11*d*, and 11*e*, are used. In a prototype model, it has been demonstrated that five bows 11 are quite adequate to form a shelter big enough to accommodate two people, and yet when collapsed, allow for ease of handling. The invention, however, is not intended to be limited to a particular number of bows 11. More bows 11 or less bows 11 may equally be used to accomplish the teachings of the invention.

Figure 2:
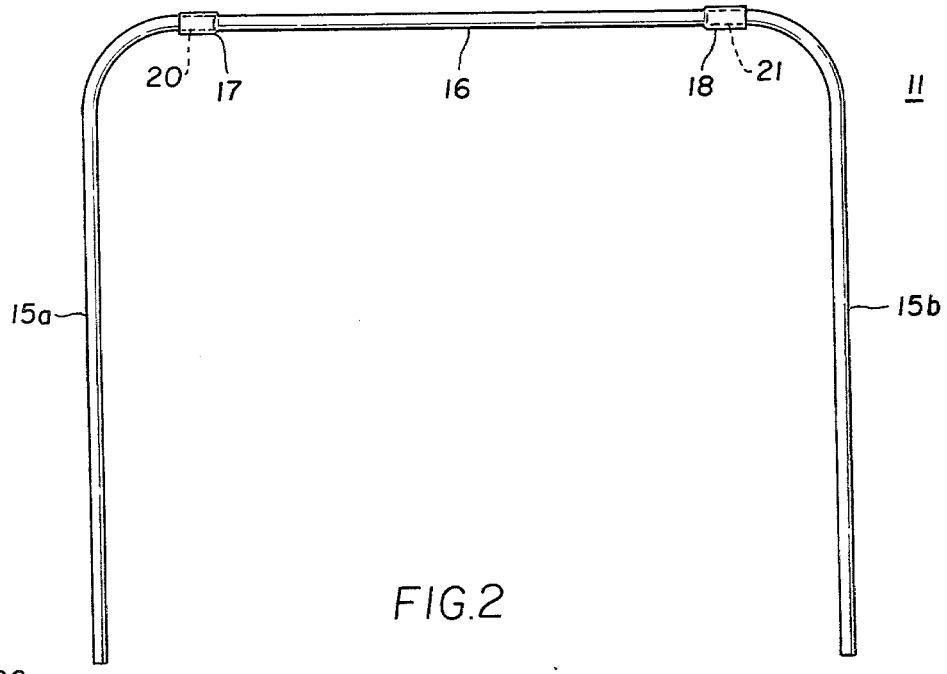
FIG. 2 illustrates a typical supporting bow in an assembled position.

A typical bow 11 of the inventive shelter 10 is shown in FIG. 2. In this figure, bow 11 is shown, for convenience, apart from its pivoted connection to hub 12. As can be seen, bow 11 is made up of at least three pieces. A first inverted "L"-shaped piece 15*a*, a second inverted "L"-shaped piece 15*b*, and a straight piece 16 interposed therebetween. In the embodiment illustrated in FIG. 1, a frontal view structure 10 reveals a "U"-shaped entrance; hence, it follows that the bows 11, have a similar "U" shape. It has been shown, with the aforementioned model, that a "U" shape having straight sides maximizes the internal vertical height of the structure 10 and, therefore, maximizes its usefulness as a personnel shelter. Then too, when structure 10 is collapsed and packaged, an essentially straight, compact package results. The latter feature aids in storage, handling, and transporting. Again, however, the teachings of the invention are equally applicable to other bow shapes such a half-circles. Such "U" shape is, therefore, not intended to limit the invention. Additionally, the bows 11 may be made of two "L"-shaped pieces (not shown) which are telescopically fitted together.

Bow 11 and its components, 15*a*, 15*b*, and 16, may be made from cadmium-plated steel tubing, aluminum tubing, painted steel, or such other material that is relatively rust free or protected against corrosion. Aluminum tubing having a ¾ inch outer diameter with a 0.047 inch wall thickness has been shown to be adequate. Such tubing has adequate strength, is easy to form and machine and is sufficiently lightweight. Side pieces 15*a*, and 15*b*, are exact replicas of each other and are, therefore, interchangeable. The ends 17 and 18 of center piece 16 are flared to the extent that ends 20 and 21 of pieces 15*a* and 15*b*, respectively, fit with clearance within ends 17 and 18. A relatively small clearance fit at ends 17 and 18 may aid in keeping bows 11 together before full erection of shelter 10 is achieved, but such a small clearance fit is not a necessity, for reasons as will be more fully explained hereinafter.

Figure 3:
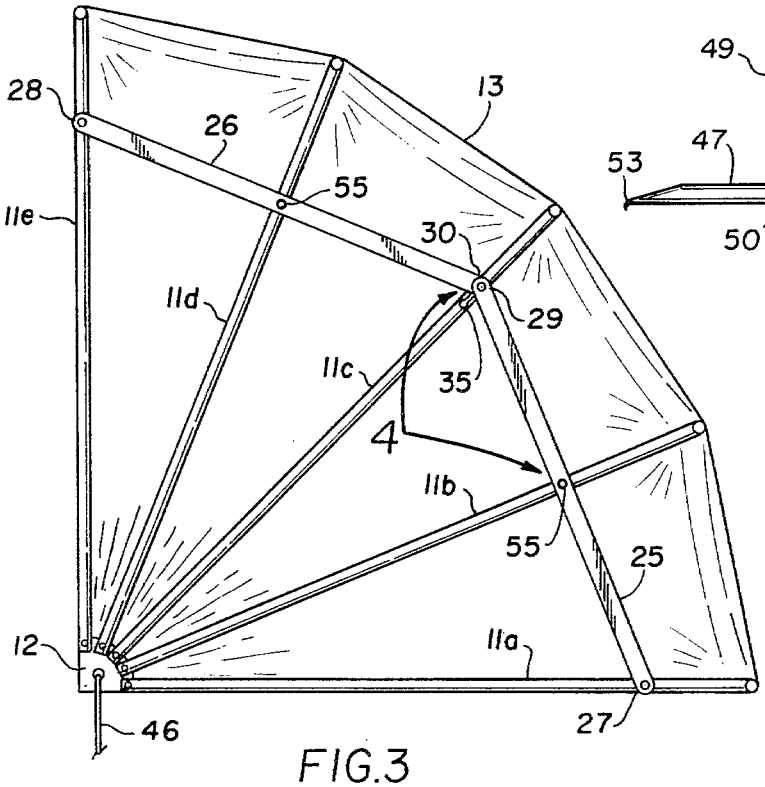
FIG. 3 is a sectional view of the inventive shelter taken along the line 3—3 of FIG. 1.
Figure 7:
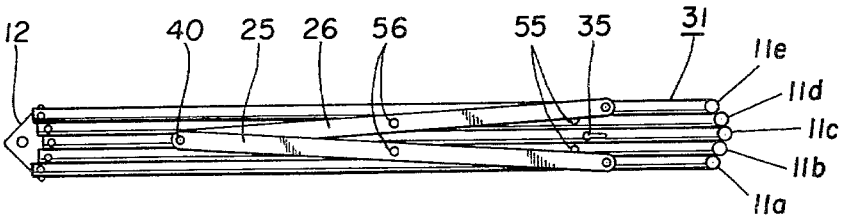
FIG. 7 is a view of a subassembly comprising the hub and side pieces of the bows in a collapsed position.

An internal side view of structure 10 is shown in FIG. 3. The fanning out of bows 11, when the structure 10 is erected, is more clearly shown in this figure. Structure 10 is held in the shown erected position by a combination of the actions of braces 25 and 26 and covering 13. End 27 of brace 25 is pinned, such as by riveting to lowermost bow 11*a*. Similarly, end 28 of brace 26 is pinned to uppermost bow 11*e*. The pinning at ends 27 and 28 must allow for relative rotation between the brace and its attached bow. The inner ends 29 and 30 of braces 25 and 26 are also pinned to each other and allow for relative rotation. When covering 13 is not attached to the structure 10, braces 25 and 26 may be moved inward toward and to the position of hub 12. In this manner, when covering 13 is not attached, each piece 16 or 15 of bows 11 and braces 25 and 26 may be collapsed one on top of each other as shown in FIG. 7. And, with the pieces 15*a* and 15*b* of bows 11 separated from pieces 16, it will be appreciated that a relatively compact subassembly 31 of structure 10 results. The subassembly 31 being hub 12 with five bow pieces 15 attached thereto and braces 25 and 26, but does not include covering 13.

Figure 4:
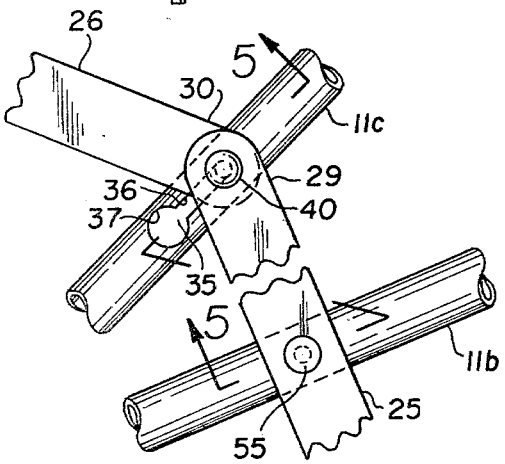
FIG. 4 is an enlarged view of a portion of FIG. 3 illustrating the intersection of the side braces and the center rib and the connection therebetween.
Figure 5:
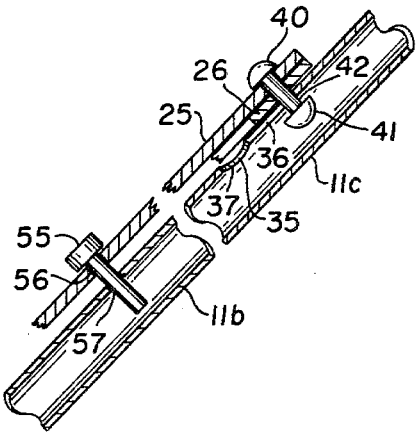
FIG. 5 is a cross-sectional view taken along the line 5—5 of FIG. 4.

FIGS. 4 and 5 show the details of the connection between braces 25 and 26 and the centermost bow 11*c* when shelter 10 is fully erected. A keyhole slot 35 is machined in pieces 15*a* and 15*b* of centermost bow 11. In FIG. 2, slot 35 would be located at the inner surfaces of side pieces 15. Keyhole slot 35 comprises an elongated slot portion 36 and a round portion 37. Round portion 37 is slightly larger than the head 41 of rivet 40. Elongated slot portion 36 has a width which is slightly larger than the diameter of the shank portion 42 of rivet 40. Therefore, round portion 37 is larger than the width of the elongated slot portion 36. The length of the elongated slot portion 36 is not critical, but should be of the order of one-half to three-quarters of an inch.

Keyhole slot 35 is axially aligned with the major axis of side pieces 15 and is positioned therein with round portion 37 closest to hub 12. Thus, the elongated portion 36 of slot 35 extends toward the upper part of shelter 10 and away from hub 12. As shown in FIGS. 3 and 4, when structure 10 is fully erected, braces 25 and 26 form an angle which is less than 180° with the vertex of the angle extending away from hub 12. Since the natural tendency of bows 11, even without cover 13 attached, is to collapse, there exists a force on braces 25 and 26 in a direction away from hubs 12. Thus, when the head of rivet 40 is inserted in keyhole slot 35, there exists a force causing rivet head 41 to slide away from hub 12 and the retained within the elongated portion 36 of slot 35. The inherent collapsing forces of bows 11 then operates to positively prevent the bows 11, and hence shelter 10 from collapsing. As will be later seen, the tautness of cover 13 also aids in securing rivet head 41 in and against the end of elongated portion 36 of slot 35 and also prevents the structure 10 from collapsing.

Braces 25 and 26 may be made from either round stock with the ends 27, 28, 29, and 30 flattened but more preferably may be made from flat stock. Inasmuch as the length of rivet 40 must allow for complete folding of brace 25 against brace 26 as when subassembly 31 is fully collapsed; flat stock permits a rivet 40 having a shorter length. The length of rivet 40 determines the looseness and amount of twisting of braces 25 and 26; hence, the shorter the length of rivet 40, the lesser the degree of twisting and looseness.

Figure 6:
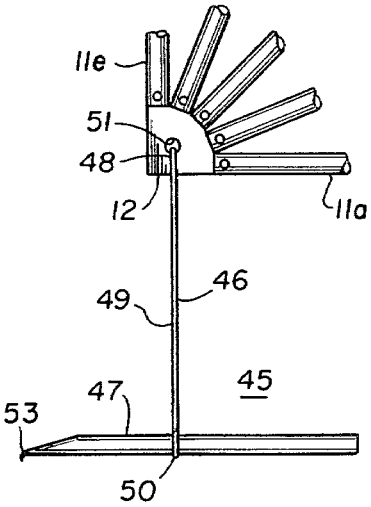
FIG. 6 is an enlarged view of the hub and anchor of FIG. 3.

Anchor assembly 45 is shown in FIG. 6. It consists of tie rod 46 and anchor 47. Tie rod 46 comprises a head 48, a body or rod 49 and an end 50. For simplicity, the rod may be formed from wire. End 50 is formed to comprise a circle having a round opening therethrough. Head 48 may be formed or bent in the shape of a hook. Hub 12 includes a hole 51 for receiving the hook end 48 of rod 46. The length of rod 49 may be of the order of twelve inches. Anchor 47 is formed from tubing and has a flattened and bent end 53. The outer diameter of anchor 47 is slightly smaller than the opening at end 50 of tie rod 46, so as to permit anchor 47 to fit within said opening.

Covering 13 is shaped to fit around bows 11 when they are extended as shown in FIGS. 1 and 2. Cover 13 is attached to the upper and lowermost bows 11*e* and 11*a*, respectively, by conventional snap fasteners (not shown). One portion of a snap fastener being attached to covering 13 while the mating portions of the fasteners are attached to the outer vertical edge of bow 11*e* and the outer horizontal edge of bow 11*a*. Such connections of the cover 13 to bows 11 allow cover 13 to exert the aforementioned compressive forces which are required to maintain bow pieces 15 and 16 in an assembled position and to provide the necessary collapsing forces which keep rivet 40 of braces 25 and 26 firmly locked within the keyhole in bow 11*c*. It follows, therefore, that cover 13 must be sized to fit properly around bows 11 when said bows 11 are fully fanned out. It is not necessary that cover 13 be attached to any intermediate bows.

In order to erect the inventive structure 10, the following procedure is utilized. The structure 10 is initially in a state suitable for transporting or storage comprising a pair of subassemblies 31 (FIG. 7) with the side pieces 15 attached to hub 12 and collapsed one on top of each other. Braces 25 and 26 are folded one against each other along side of the bow pieces 15. Anchor assembly 45 may or may not be attached to hub 12, but cover 13 is not snap fitted to bows 11. Bow center pieces 16 are bundled against each other along side of the two subassemblies 31. Outer covering 13 is folded in an approximate square or rectangular shape and is wrapped around the pair of subassemblies 31 and the bundled bow center pieces 16 and appropriately tied with string or cord (not shown). Assuming anchor assemblies 45 are detached from hubs 12, anchors 47 are detached from tie rods 46 and are positioned within the wrapped shelter 10. Tie rods 46 are folded back against hub 12 in line with bow pieces 15. The shelter 10 thus described forms a package having an approximate diameter of 6-8 inches and is approximately 4½ to 5 feet long. (Assuming that a two-man shelter is used.)

Upon selecting a site to erect the structure 10, the above-described package is unrolled. At this point in time, each subassembly 31 is positioned on the ground parallel to each other and spaced apart by a distance approximately equal to the length of a bow center piece 16. Bow pieces 16 are then connected to bow pieces 15 to form five "U"-shaped bows. The shape and fit of mating ends 18 and 21, and 17 and 20, temporarily allow the bows 11 to remain connected. Ends 29 and 30 of braces 25 and 26, respectively, are moved away from hub 12 and toward what ultimately will be the upper part of structure 10. In order to do this, it will be necessary to fan out bow pieces 15 of each subassembly 31. Bows 11 are then fully fanned out by applying a force to the pinned braces 25 and 26 at their ends 29 and 30 in the direction away from hub 12. Rivet head 41 will at this time be positioned at the round end 37 of keyhole slot 35 and is inserted therein. A slight extra force at the pinned ends 29 and 30 of braces 25 and 26 causes rivet 40 to slide along elongated portion 36 of keyhole slot 35 and stops when the end thereof is reached.

The inherent collapsing action of bows 11 together with the angle formed by braces 25 and 26 cause rivet 40 to maintain its position at the end of the elongated slot portion 36 of keyhole slot 35 which end is furthermost away from hub 12. It will be appreciated at this point of the erection sequence of shelter 10, that the structural framework of shelter 10 is fully erected and is temporarily held together by the innovations of the invention heretofore described.

Covering 13 is draped over the framework of shelter 10 and then snap fitted to either bow 11*a* or 11*e*. Covering 13 is finally snap fitted to the remaining end bow, either 11*e* or 11*a*, respectively. In order to connect covering 13 to the last bow 11, it will be necessary to pull covering 13 taut. Connection of covering 13 to the last bow center piece 16 will cause rivet 40 to be firmly locked in position in keyhole slot 35. Connection of covering 13 to bow pieces 15 will cause bow pieces 15*a*, 16, and 15*b* to be firmly connected to each other. Thus, the interrelating forces of the bows 11, covering 13, and braces 25 and 26 as they act and react with each other, maintain the shelter 10 in a fully erected position.

Should covering 13 be made from a material which has a slight amount of give or stretch to it, a slightly different erection procedure may be utilized. The same steps as previously are used to assemble together bow pieces 15*a*, 16, and 15*b* of the two subassemblies 31. The covering 13, however, is then connected to both end bows 11*a* and 11*e* before the bows 11 are fanned out. Braces 25 and 26 are moved away from hub 12 to a position over dead center and beyond keyhole slot 35. Thus, bows 11 are not quite fully fanned out. The pinned end of braces 25 and 26 are forced back toward keyhole slot 35 causing bows 11 to be fully fanned out when rivet head 41 reaches the end of the elongated portion 36 of slot 35. A slight extra force causes the covering 13 to slightly stretch and aligns rivet head 41 with the round portion 37 of slot which is inserted therein. The tautness and slight stretching of covering 13 results in rivet 40 sliding up slot 35 toward the elongated portion 36 thereof. Again, shelter 10 is maintained in a fully erected position by the same interacting forces heretofore described.

With either assembly procedure, headed pins 55 are then inserted in holes 56 of braces 25 and 26 which are aligned with holes 57 in bows 11*b* and 11*d*. Headed pins 55 thus allow for proper and fixed positioning of bows 11*b* and 11*d*.

Should it be desired to secure or anchor the shelter 10 to the ground or in sand, anchor assemblies 45 are used. Anchor 47 is used to dig a small trench having the length of anchor 47 and the depth of tie rod 46. The flattened and curved end 53 of anchor 47 is used for this purpose. Upon digging the trench of requisite size, tie rod 46 is inserted in hole 51 into the trench and anchor 45 is inserted in the opening 50 of tie rod 46 within the trench. The dug up earth or sand, as the case may be, is then backfilled into the trench, burying the anchor therein. Shelter 10 is then immune from being moved by wind. It is to be noted, that the connection of anchor assembly 45 to hub 12 allows shelter 10 to be rotated or flipped over end-for-end without disturbing the anchoring. Such feature provides for continuing shelter from the sun as the sun changes position overhead.

To collapse shelter 10, a procedure substantially in reverse to the above-described erection procedure is utilized.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

I claim:

1. A shelter of the type which is portable and collapsible adapted for use on either a natural ground surface or a man-made surface comprising frame means for supporting said shelter when said shelter is fully erected cover means extending over said frame means and attached thereto for applying compressive forces to said frame means and for applying forces tending to collapse said frame means when fully extended brace means attached to said frame means for opposing said collapsing forces, wherein said frame means comprises a first substantially vertical, a last substantially horizontal, and at least one intermediate curved bow members, pivotally attached to their ends to a pair of spaced hub members forming a curved structure having substantially vertical sides, and said brace means includes a pair of oppositely disposed braces attached to said substantially vertical sides, said braces each comprising a first link pivotally attached at one end to said vertical bow and a second link attached at one end to said horizontal bow, the other ends of said links being pivotally attached to each other at their other ends by a connector having a headed stem extending therefrom, said intermediate bow having a keyhole slot formed therein with a larger round portion of said slot being disposed toward said hub member and an elongated portion of said slot extending away from said hub member, said headed stem being received within said keyhole slot and being positioned at the elongated portion of said slot when said structure is fully erected, said links forming an angle therebetween having the apex thereof extending away from said hub member.

2. A shelter of the type which is portable and collapsible adapted for use on either a natural ground surface or a man-made surface comprising frame means comprising a first bow, a second bow and at least one intermediate bow therebetween, a pair of spaced hubs, the ends of said bows being pivotally attached to said hubs cover means extending over said frame and attached thereto for applying compressive forces to said frame and for applying forces tending to collapse said frame when fully extended brace means comprising link members pivotally attached to said first and second bows and to each other, said links forming an angle therebetween having the apex thereof extending away from said hub means detachably connecting said links to said intermediate bow for extending said frame and for locking said links to said intermediate bow by the collapsing forces of said cover.

3. The shelter of claim 1, including means for anchoring said shelter to a natural ground surface.

4. The shelter of claim 1, wherein each of said bows is made up of at least two detachable pieces which are held together when the shelter is fully erected by said compressive forces applied by the cover.

5. The shelter of claim 4, wherein said bow pieces are telescopically fitted to each other.

6. The shelter of claim 1, wherein each of said bows comprise at least three detachable bow pieces including a first side piece, a top piece, and a second side piece said top piece being interposed between said side pieces, said bow pieces being held together by the compressive forces applied by the cover when the structure is fully erected.

7. The shelter of claim 6, wherein said top piece is telescopically fitted at each end thereof to each side piece.

8. The shelter of claim 7, wherein said top piece comprises a substantially straight elongated tube and each of said side pieces comprises an elongated tube having an "L" shape with the short leg thereof being attached to said top piece.

9. The shelter of claim 1 wherein said cover comprises a thin flexible material detachably connected to said first and second bows and is substantially non-stretchable.

10. The shelter of claim 3, wherein said anchor means comprises a first elongated rod attached at one end to said hub member and extending vertically downward therefrom, and a second elongated rod attached to the second end of said first elongated rod at a right angle thereto, said anchor being adapted to be buried within a backfilled trench due in the natural ground surface.

11. The shelter of claim 10, wherein said second elongated rod includes digging means comprising a curved tip at one end thereof.

12. The shelter of claim 11, wherein said second elongated rod is horizontally positioned within said backfilled trench such that said flattended and curved tip extends downward from a horizontal plane.

* * * * *